US006316749B1

(12) United States Patent
Bales et al.

(10) Patent No.: US 6,316,749 B1
(45) Date of Patent: Nov. 13, 2001

(54) SELF-CLEANING SYSTEM FOR A COOKING APPLIANCE

(75) Inventors: Michael E. Bales, Cleveland; John Scott Brown, Charleston, both of TN (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 09/650,416

(22) Filed: Aug. 29, 2000

(51) Int. Cl.[7] ..... A21B 1/26; A21B 1/40; F24C 14/02

(52) U.S. Cl. ..... 219/400; 219/396; 219/398; 219/413

(58) Field of Search ..... 219/400, 391, 219/393, 396, 398, 412, 413; 126/21 A, 273 R

(56) References Cited

U.S. PATENT DOCUMENTS

| | | | | |
|---|---|---|---|---|
| 3,166,895 | | 1/1965 | Slayter et al. . | |
| 3,327,094 | | 6/1967 | Martin et al. . | |
| 3,428,434 | | 2/1969 | Hurko . | |
| 3,428,435 | | 2/1969 | Hurko et al. . | |
| 3,440,402 | | 4/1969 | Holtkamp . | |
| 3,480,000 | | 11/1969 | Torrey et al. . | |
| 3,549,859 | | 12/1970 | Faehling et al. . | |
| 3,553,425 | | 1/1971 | Fry . | |
| 3,556,077 | | 1/1971 | Tikas . | |
| 3,656,469 | | 4/1972 | Jung et al. . | |
| 3,669,090 | | 6/1972 | Jung et al. . | |
| 3,727,601 | * | 4/1973 | Klement | 126/21 A |
| 3,899,656 | | 8/1975 | Smith . | |
| 3,915,149 | | 10/1975 | Kemp . | |
| 3,962,561 | | 6/1976 | Maitenaz . | |
| 4,039,292 | | 8/1977 | Morini et al. . | |
| 4,054,418 | | 10/1977 | Miller et al. . | |
| 4,238,670 | | 12/1980 | Maitenaz . | |
| 4,302,661 | | 11/1981 | Perry, Jr. . | |
| 4,374,319 | * | 2/1983 | Guibert | 219/400 |
| 4,375,213 | | 3/1983 | Kemp et al. . | |
| 4,392,038 | | 7/1983 | Day et al. . | |
| 4,493,976 | | 1/1985 | Wilson . | |
| 4,547,642 | | 10/1985 | Smith . | |
| 4,827,106 | | 5/1989 | Margraf . | |
| 4,831,237 | | 5/1989 | Gelineau . | |
| 4,926,837 | | 5/1990 | Parker et al. . | |
| 4,954,694 | | 9/1990 | Nagai et al. . | |
| 5,083,010 | | 1/1992 | Henry et al. . | |
| 5,205,273 | * | 4/1993 | Sparks et al. | 126/21 A |
| 5,286,943 | | 2/1994 | Has . | |
| 5,343,020 | | 8/1994 | Waigand et al. . | |
| 5,386,099 | * | 1/1995 | Has | 219/413 |
| 5,534,678 | | 7/1996 | Bowles et al. . | |
| 5,571,433 | | 11/1996 | Baker . | |
| 5,964,211 | | 10/1999 | Sargunam et al. . | |

FOREIGN PATENT DOCUMENTS

2166227 * 12/1978 (DE) .

* cited by examiner

*Primary Examiner*—Joseph Pelham
(74) *Attorney, Agent, or Firm*—Diederiks & Whitelaw, PLC

(57) ABSTRACT

A self-cleaning system for a convection cooking appliance controls the activation and deactivation of multiple heating units, as well as a blower, throughout an initial preheat and subsequent phases of a cleaning operation. More particularly, at least first, second and third heating units are provided, with two of the units being positioned in an air channel assembly which extends about at least a portion of the oven cavity and the remaining heating unit being positioned within the oven cavity. The heating units in the air channel assembly are activated, along with a blower, during a preheat phase to heat the oven cavity at a controlled rate, while developed byproducts are directed through a catalyst. Following the preheat phase, the blower and one of the heating units in the air channel assembly are deactivated, while the heating unit in the oven cavity is activated to rapidly increase the temperature of the oven cavity.

20 Claims, 5 Drawing Sheets

SELF-CLEANING SYSTEM FOR A COOKING APPLIANCE

BACKGROUND OF THE INVENTION

1. Field of the Invention

The present invention pertains to the art of cooking appliances and, more particularly, to a system for cleaning a cooking appliance.

2. Discussion of the Prior Art

In the art of cooking appliances, it has been heretofore proposed to enable an appliance to operate in a self-cleaning mode. For example, in a conventional range having a cooking cavity which can be heated by one or more cooking elements arranged within the cooking cavity to perform at least baking and broiling functions, it is known to operate one or more of the cooking elements to perform a pyrolytic self-cleaning operation in order to cleanse the walls of the cavity from grease and other food soils developed during normal cooking operations. In such a cooking arrangement, the cooking elements used to perform the cleaning process are located entirely within the cooking cavity.

In addition, it is known to provide a catalytic self-cleaning oven. In such an arrangement, the walls of the oven are coated with a catalytic material which provides for self-cleaning of the oven cavity during cooking operations. In performing any self-cleaning function, byproducts, including smoke, gases and other odorous fumes, are inherently produced. A typical oven cavity will be vented to permit the escape of these byproducts to the ambient surroundings. In some cases, a catalytic oxidation unit is provided in the vent to react with the flowing byproducts.

In still other self-cleaning arrangements, a combination of pyrolytic and catalytic cleaning is performed. Regardless of the fact that various self-cleaning systems have been proposed in the art, there still exists a need for an improved self-cleaning system for a cooking appliance which maximizes the elimination of byproducts, while also minimizing the necessary operating time for the self-cleaning mode. Particular concerns are raised in connection with the necessary operating time and byproduct elimination in a self-cleaning convection oven which essentially relies on a heated flow of recirculating air for raising the temperature in an oven cavity. In any event, there exists a particular need for an improved selfcleaning system for a convection cooking appliance.

SUMMARY OF THE INVENTION

The present invention is directed to a system for self-cleaning an oven cavity of a cooking appliance including an air channel assembly which is defined by ducting extending about portions of the oven cavity for directing a recirculating flow of air into and out of the oven cavity. The overall system utilizes various heating elements, as well as a catalyst, to enhance the pre-heating of the oven cavity, efficiently eliminate developed smoke, odor and other byproducts, and effectively reduce the necessary cleaning cycle time for the appliance.

In accordance with a preferred embodiment of the invention, the convection cooking appliance includes first, second and third heating units which are individually controlled, along with a blower unit, in performing a self-cleaning function for the appliance. The first and third heating units are disposed in the air channel assembly, while the second heating unit is positioned in the oven cavity. A controller is provided for regulating the activation and deactivation state of the various components in a manner which preheats the oven cavity in a relatively short time period, while assuring that initially developed smoke, gases and other odorous fumes inherently produced as byproducts of a self-cleaning operation are effectively eliminated.

During the preheat phase of the cleaning mode, the controller initially activates the blower element in combination with each of the first and third heating units in the air channel assembly, with the developed flow of air through the oven cavity being directed to the catalyst for elimination of the byproducts. Following the preheat phase, at least the blower and the third heating element are deactivated and the second heating unit is activated to rapidly heat the oven cavity through a radiant heating operation. A temperature sensor is linked to the controller to efficiently determine the optimum time to switch between the various heating sources for the oven cavity during the overall self-cleaning operation.

Additional objects, features and advantages of the present invention will become more fully apparent below with reference to a preferred embodiment of the invention, when taken in conjunction with the drawings wherein like reference numerals refer to corresponding parts in the several views.

DETAILED DESCRIPTION OF THE PREFERRED EMBODIMENT

Figure 1:
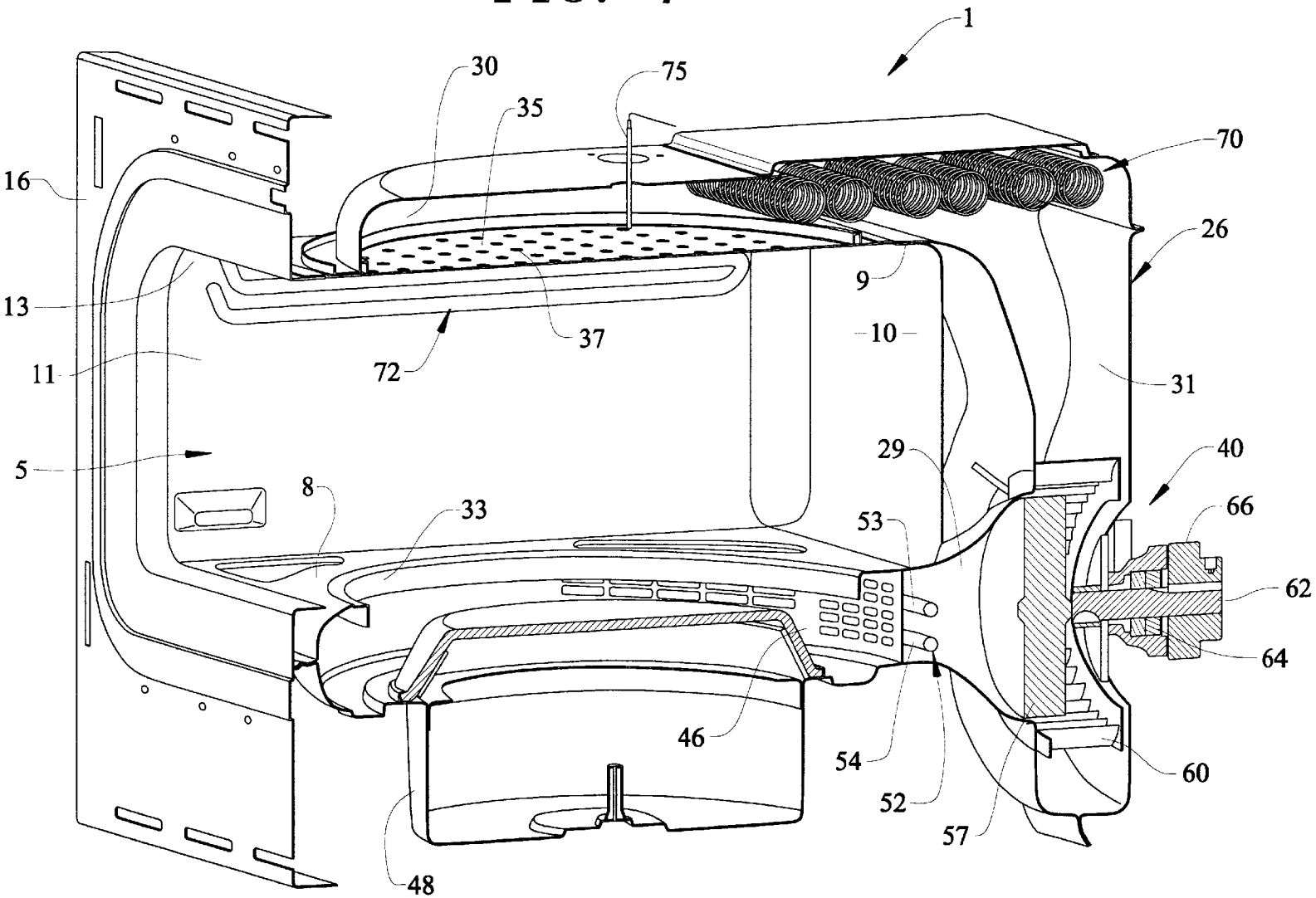
FIG. 1 is a perspective, partial sectional view of a self-cleaning convention cooking appliance constructed in accordance with the present invention.
Figure 2:
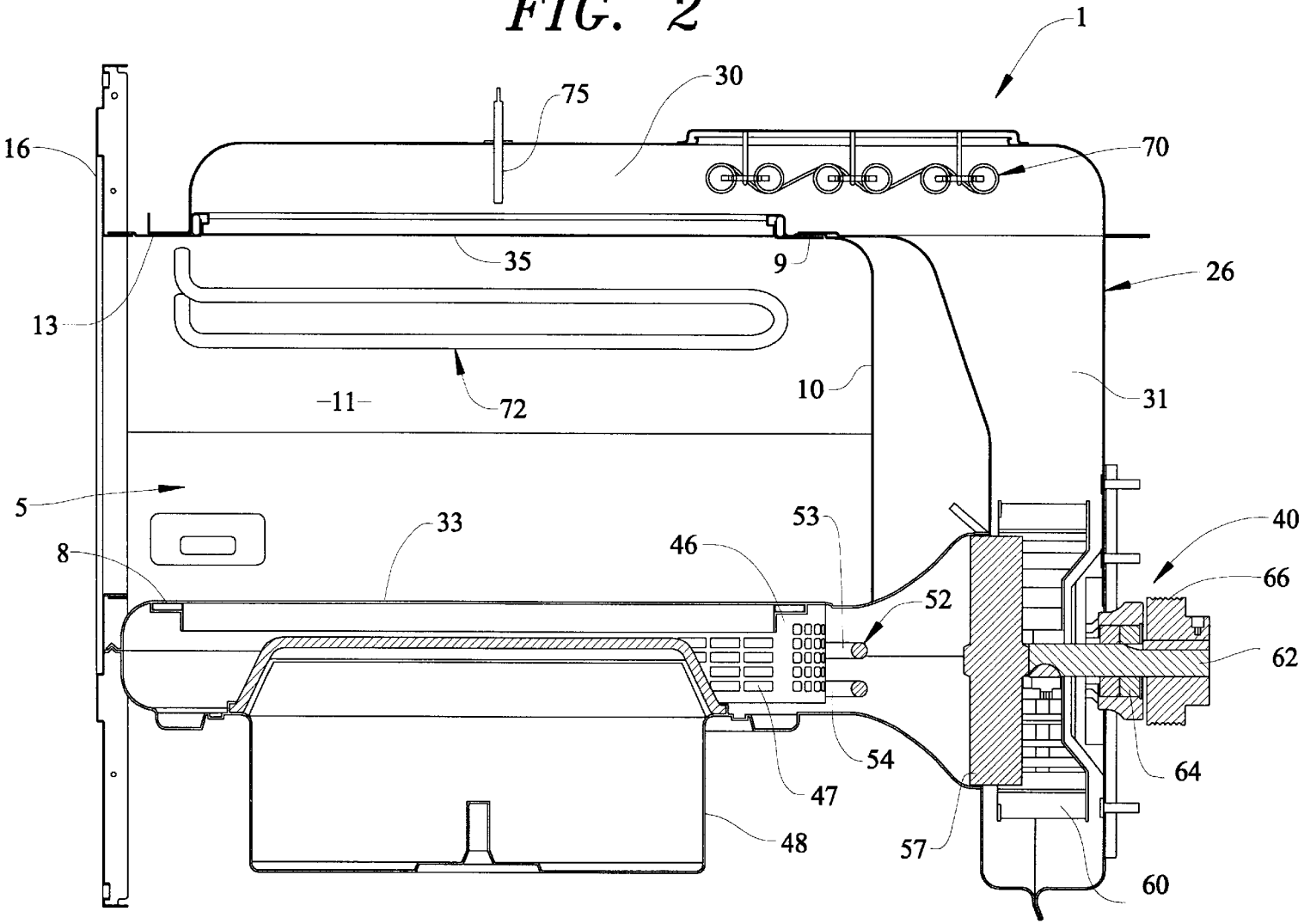
FIG. 2 is a cross-sectional side view of the cooking appliance of FIG. 1.
Figure 3:
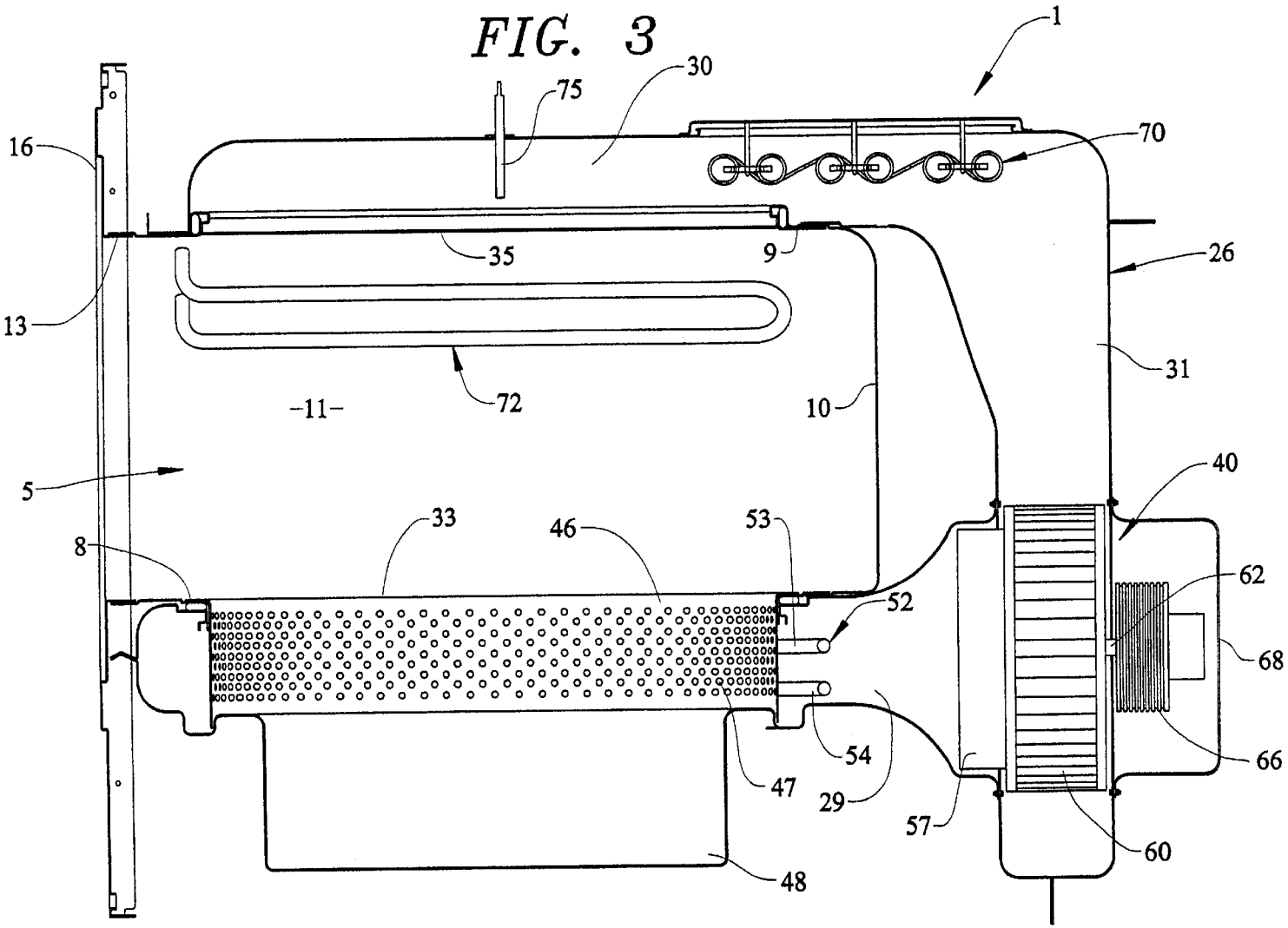
FIG. 3 is a schematic side view, similar to that of FIG. 2, of the cooking appliance.

With initial reference to FIGS. 1–3, a cooking appliance 1 is schematically shown in the form of a wall oven. Appliance 1 includes an oven cavity 5 generally defined by a bottom wall 8, a top wall 9, a rear wall 10 and a pair of side walls, one of which is indicated at 11. Oven cavity 5 also has associated therewith an access opening 13 for food items to be placed into or withdrawn from cavity 5. About access opening 13 is provided a frontal plate 16. In a manner known in the art, frontal plate 16 is adapted to be mounted against a substantially vertical wall such as in the kitchen of a residential home, and would have a door (not shown) pivotally attached thereto for selectively sealing off access opening 13.

Extending generally along top, bottom and rear portions of cavity 5 is an air channel assembly 26 defined by ducting that leads into and out of cavity 5. More specifically, air channel assembly 26 includes a lower air return section 29, an upper air delivery section 30 and a rear air transfer section 31. Lower air return section 29 is open into cavity 5 through a substantially central return air outlet 33 formed in bottom 8. In the most preferred form of the invention, return air outlet 33 is constituted by a generally circular insert provided with various spaced holes (not shown). In a similar manner, upper air delivery section 30 includes a discharge or delivery inlet 35 formed in top wall 9. Although only partially shown in FIG. 1, inlet 35 is also preferably constituted by a generally circular-shaped insert which is attached to the remainder of upper air delivery section 30 and which is provided with a plurality of holes 37.

As will become more fully evident below, the particular construction of cooking appliance 1 can significantly vary in accordance with the present invention. More specifically, it is only important in accordance with the present invention that cooking appliance 1 include an air channel assembly, such as that discussed above with reference to assembly 26, as well as a blower assembly, such as that generally indicated at 40, for use in generating a circulating flow of air through oven cavity 5. Although not considered a part of the present invention, a preferred construction for oven cavity 5 and air channel assembly 26 can be found in U.S. patent application entitled "OVEN CAVITY CONSTRUCTION" filed on even date herewith which is hereby incorporated by reference.

In the preferred embodiment shown, cooking appliance 1 constitutes an electric appliance and, more specifically, a combination convection, microwave and radiant cooking device. As shown in this figure, cooking appliance 1 is provided with an annular filter basket 46, having a multitude of circumferentially spaced holes 47, which is positioned within lower air return section 29 and through which the air flowing from cavity 5 through return air outlet 33 is directed. Arranged below filter basket 46 is a microwave generator unit 48 incorporating a magnetron (not specifically shown).

Encircling at least a portion of filter basket 46 is a first electric heating element 52. Heating unit 52 is shown as constituted by a sheathed electric resistance heating element having upper and lower interconnected legs 53 and 54. First electric heating unit 52 is preferably provided to heat return air flowing from oven cavity 5, through outlet 33 and filter basket 56 prior to the air reaching a catalyst indicated at 57. In a manner known in the art, catalyst 57 functions to eliminate smoke and the like from the air stream. As shown, catalyst 57 extends partially within a rotatable blower element 60 which forms part of blower assembly 40. Although blower element 60 can take various forms while performing the desired air flow generating function, blower element 60 preferably constitutes a centrifugal unit arranged at the juncture of lower air return section 29 and rear air transfer section 31. In general, blower element 60 is secured to a shaft member 62 that is rotatably mounted through a bearing assembly 64. Shaft member 62 also has attached thereto, for non-relative rotation, a sheave 66 which is adapted to receive a belt (not shown) for use in rotating blower element 60 through shaft member 62 in combination with an electric motor (also not shown). As illustrated, sheave 66 is preferably arranged within a housing extension 68 which projects from rear air transfer section 31.

Preferably mounted in upper air delivery section 30 adjacent rear transfer section 31 is a second electric heating element arrangement 70 that is preferably constituted by a bank of heating coils. Although not pertinent to the present invention, second heating unit 70 can be defined by a single electric coil that runs back and forth across upper air delivery section 30 or multiple, separately controllable coil elements. In any event, second heating unit 70 functions to further heat the air flowing through channel assembly 26 prior to the air reaching discharge inlet 35.

Also shown in this figure is a third electric heating unit 72 which, in a manner similar to first electric heating unit 52, is preferably constituted by a sheathed, resistance-type heating element. Third electric heating unit 72 preferably extends adjacent top wall 9 and constitutes an additional heat source for cavity 5 of cooking appliance 1. The particular manner in which first, second and third electric heating units 52, 70 and 72 are utilized during operation of cooking appliance 1 for a cooking mode of operation is not considered to constitute part of the present invention. Instead, these details can be found in U.S. patent application entitled "HEATING SYSTEM FOR A COOKING APPLIANCE" filed on even date herewith and incorporated by reference.

Figure 4:
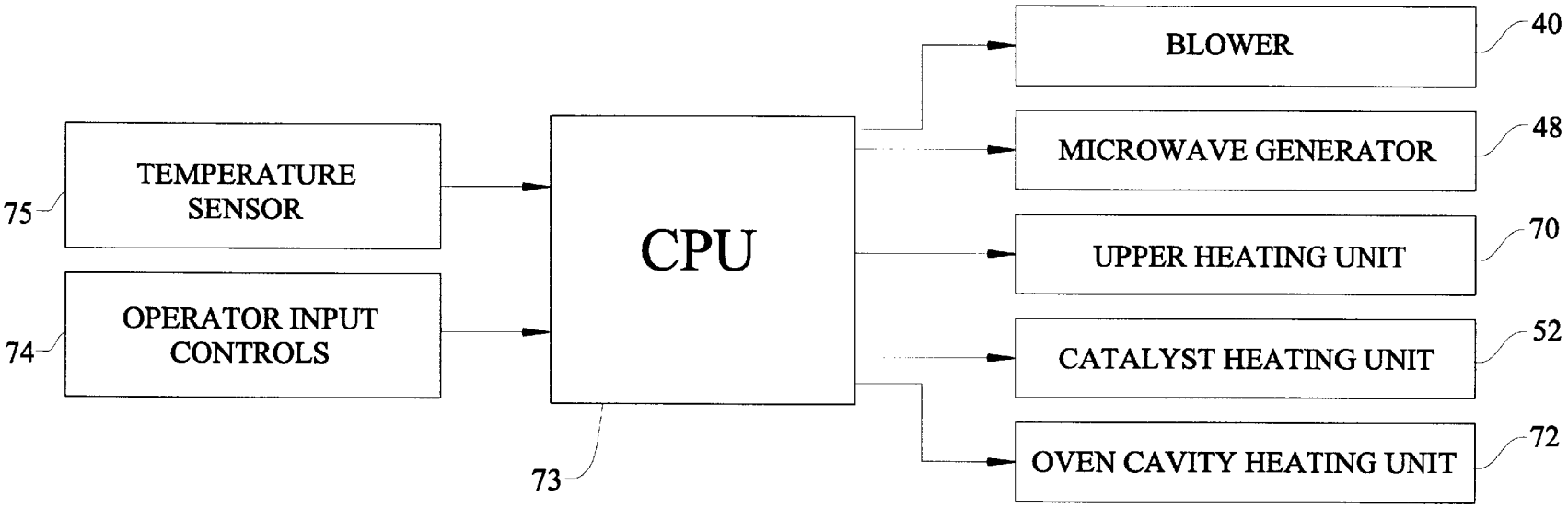
FIG. 4 is a block diagram illustrating a control arrangement used in the self-cleaning system of the invention.

As represented in FIG. 4, each of blower assembly 40, microwave generator 48 and first, second and third electric heating units 52, 70 and 72 are linked to an appliance controller or CPU 73. Controller 73 also receives signals from operator input controls 74, as well as from a temperature sensor 75 which is preferably arranged in upper air delivery section 30, between heating unit 70 and delivery inlet 35. The present invention is particularly directed to the manner in which cooking appliance 1 is operated through a cleaning mode.

When an operator selects a cleaning mode through input controls 74, heating units 52 and 70 are initially activated, along with blower assembly 40, for preheating of oven cavity 5. At the same time, during this preheat phase, heating unit 72 is maintained deactivated. This operational stage enables the oven cavity 5 to be heated in a substantially exponential manner as represented by the portion A of the time/temperature curve shown in FIG. 5. This arrangement is designed to provide for a relatively short preheat time period, while assuring that early stage self-clean byproducts will flow to the catalyst for effective elimination. That is, it is this initial time period that substantial amounts of smoke, odors and other byproducts will be developed due to the burning off of grease and the like remaining in the oven cavity 5. By maintaining heating unit 72 deactivated, it has been found that an optimum preheat rate is established, with the temperature rise being based on the flow of heated air directed through the oven cavity 5.

Figure 5:
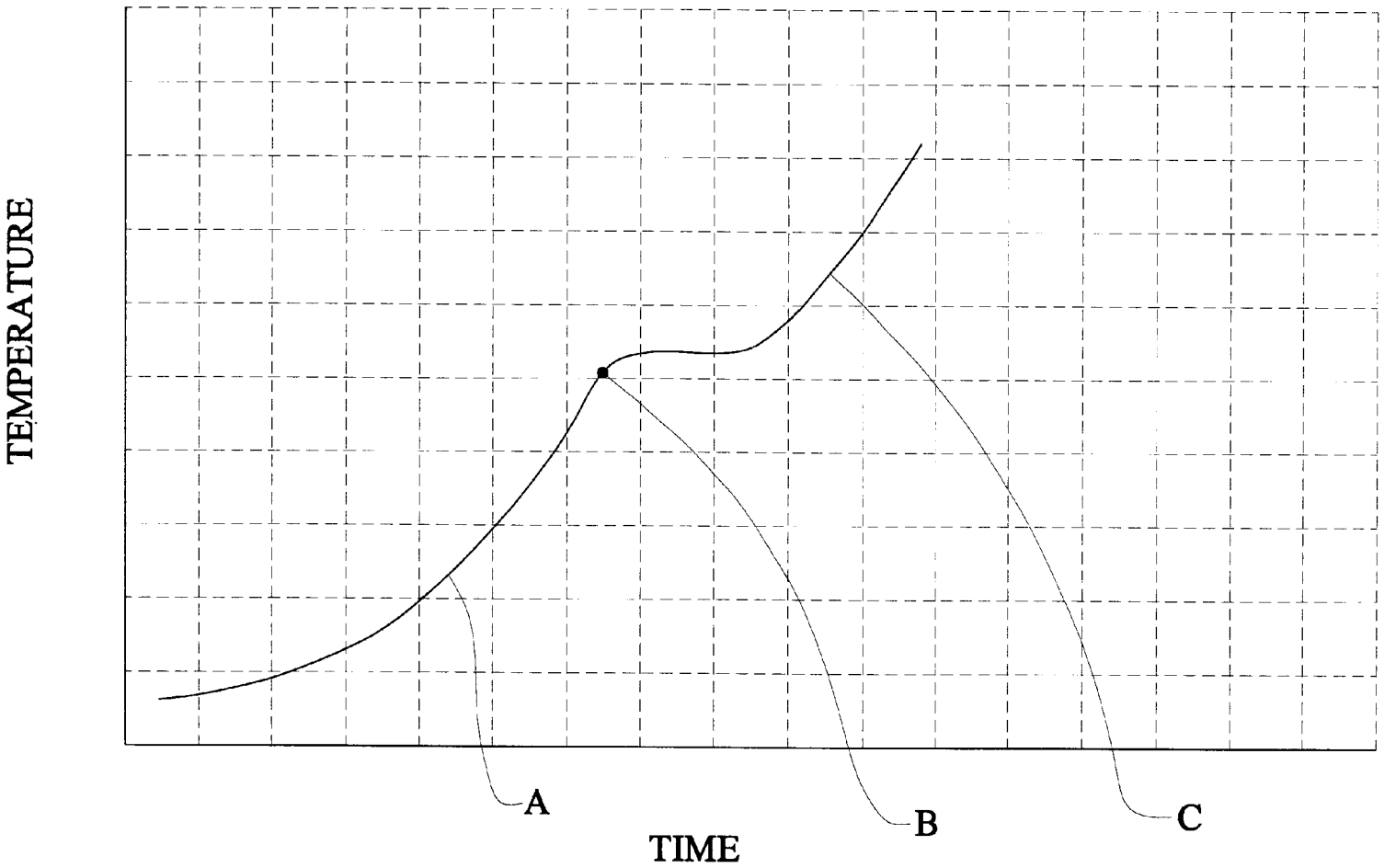
FIG. 5 depicts a graph illustrating a time versus temperature curve followed in accordance with a preferred embodiment of the invention.

When the temperature in oven cavity 5 reaches point B on the curve shown in FIG. 5, which is generally in the order of 525°–550° F. as conveyed through temperature sensor 75, blower assembly 40 and heating unit 70 are deactivated, while heating unit 52 remains activated and heating unit 72 in oven cavity 5 is also activated, through controller 73. With blower element 40 deactivated, the air flowing through air channel assembly 26 is based on natural convection only. This switchover phase results in a short, generally steady state time period wherein the temperature within oven cavity 5 remains substantially constant. However, electric heating unit 72 is preferably a high wattage element which rapidly heats such that the temperature within oven cavity again rises exponentially, as represented by portion C in FIG. 5, to a temperature preferably in the order of 930°–950° F. In fact, as clearly shown, portion C has an even higher associated slope than portion A.

With this overall control arrangement, the preheat phase is performed at a rate which assures that the developed byproducts are effectively eliminated and vented through catalyst 57, while the subsequent rapid heating of oven cavity 5 with heating unit 72 enables the time needed to perform the overall self-cleaning operation to be minimized. Although described with respect to a preferred embodiment of the invention, it should be readily understood that various changes and/or modifications can be made to the invention without departing from the spirit thereof. For example, it should be noted that the various heating units, particularly heating units 52 and 70, could be variable so as to be operated at increasing wattage ratings during the cleaning mode. In addition, blower element 60 could also be operated at variable speeds without departing from the invention. Furthermore, although heating element 70 is preferably constituted by a single bank of open coils, multiple sets of coils could be utilized and individually controlled. In any event, the invention is only intended to be limited by the scope of the following claims.

What is claimed is:

1. In a cooking appliance adapted to operate in at least cleaning and convection cooking modes, a self-cleaning system comprising:

an oven cavity;

an air channel assembly extending about at least a portion of and being in fluid communication with the oven cavity;

a blower element for developing a flow of air within the air channel assembly and through the oven cavity;

a first heating unit positioned in the air channel assembly for heating the flow of air;

a second heating unit positioned in the oven cavity; and a controller for regulating an activation and a deactivation state of each of the blower element and the first and second heating units during the cleaning mode.

2. The self-cleaning system according to claim 1, wherein the controller initially activates the blower element and the first heating unit, while maintaining the second heating unit deactivated, during an oven preheat phase of the cleaning mode.

3. The self-cleaning system according to claim 2, wherein the controller maintains the first heating unit activated and further activates the second heating unit following the preheat phase.

4. In a cooking appliance adapted to operate in at least cleaning and convection cooking modes, a self-cleaning system comprising:

an oven cavity;

an air channel assembly extending about at least a portion of and being in fluid communication with the oven cavity;

a blower element for developing a flow of air within the air channel assembly and through the oven cavity;

a first heating unit positioned in the air channel assembly for heating the flow of air;

a second heating unit positioned in the oven cavity;

a third heating unit positioned in the air channel assembly for further heating the flow of air; and a controller for regulating an activation and a deactivation state of each of the blower element and the first and second heating units during the cleaning mode.

5. The self-cleaning system according to claim 4, further comprising: a catalyst arranged in the air channel assembly.

6. The self-cleaning system according to claim 5, wherein the catalyst is located between the first heating unit and the blower element.

7. The self-cleaning system according to claim 5, wherein the first heating element is located directly upstream of the catalyst.

8. The self-cleaning system according to claim 6, wherein the catalyst operates throughout the entire cleaning mode.

9. The self-cleaning system according to claim 4, wherein the first and second heating units comprise sheathed, electric resistance type heating elements.

10. The self-cleaning system according to claim 1, further comprising: a temperature sensor for sensing an operating temperature of the cooking appliance during the cleaning mode.

11. The self-cleaning system according to claim 10, wherein the temperature sensor is arranged in the air channel assembly.

12. A method of performing a self-cleaning operation for an oven cavity of a convection cooking appliance comprising:

developing a flow of air in an air channel assembly which extends about at least a portion of the oven cavity;

activating a first heating unit within the air channel assembly to heat the flow of air;

directing the flow of air through the oven cavity; and further heating the oven cavity by activating a second heating unit positioned within the oven cavity.

13. The method according to claim 12, further comprising: maintaining the second heating unit deactivated during a preheat phase of the self-cleaning operation.

14. The method according to claim 12, further comprising: maintaining the first heating unit activated following the preheat phase.

15. The method according to claim 13, further comprising: activating a third heating unit, positioned within the air channel assembly, during the preheat phase.

16. The method according to claim 15, further comprising: directing the flow of air, exiting the oven cavity, through a catalyst positioned within the air channel assembly.

17. The method according to claim 16, further comprising: heating the catalyst with the first heating unit.

18. The method according to claim 13, further comprising: heating the oven cavity, following the preheat phase, solely with the first and second heating units.

19. The method according to claim 18, further comprising:

sensing a temperature in the cooking appliance directly within the air channel assembly; and regulating the activation and deactivation of the first, second and third heating units based on the sensed temperature.

20. A method of performing a self-cleaning operation for an oven cavity of a convection cooking appliance comprising:

developing a flow of air in an air channel assembly which extends about at least a portion of the oven cavity;

activating a first heating unit within the air channel assembly to heat the flow of air;

sensing a temperature in the cooking appliance directly within the air channel assembly;

directing the flow of air through the oven cavity;

further heating the oven cavity by activating a second heating unit positioned within the oven cavity; and regulating the activation and deactivation of at least one of the first and second heating units based on the sensed temperature.

* * * * *